United States Patent [19]

Salomon

[11] 4,183,549

[45] Jan. 15, 1980

[54] SAFETY BINDING WITH MANUAL RELEASE

[75] Inventor: Georges P. J. Salomon, Annecy, France

[73] Assignee: Etablissements Francois Salomon et Fils, Annecy, France

[21] Appl. No.: 759,406

[22] Filed: Jan. 14, 1977

[30] Foreign Application Priority Data

Jan. 16, 1976 [FR] France ..... 76 01102

[51] Int. Cl.[2] ..... A63C 9/084

[52] U.S. Cl. ..... 280/632

[58] Field of Search ..... 280/632, 634, 631

[56] References Cited

U.S. PATENT DOCUMENTS

| | | | |
|---|---|---|---|
| 3,580,597 | 5/1971 | Beyl | 280/632 |
| 3,778,073 | 12/1973 | Salomon | 280/632 |
| 3,933,363 | 1/1976 | Schweizer et al. | 280/632 |

*Primary Examiner*—David M. Mitchell

*Attorney, Agent, or Firm*—Pollock, Vande Sande & Priddy

[57] ABSTRACT

A voluntary-ski-removal lever pivots about a first axis integral with a piston and moving therewith. By means of a ramp, this lever cooperates with a fixed axle about which a jaw pivots in such a manner that, when the lever is depressed, this movement brings the first axis and the fixed axle together, thus causing the piston to move back and to release the jaw.

15 Claims, 12 Drawing Figures

SAFETY BINDING WITH MANUAL RELEASE

The present invention relates to safety bindings comprising an element adapted to be actuated by the user, the element assuring that the jaw is released so that it may be opened without the use of undue force.

The invention relates, more particularly, to safety bindings, especially those which secure the heel of the boot to a ski and which comprise:

(a) a binding element mounted upon the ski;

(b) a jaw articulated to the binding element in such a manner that the jaw may rock between a position in which the boot is secured to the ski, and a position in which the boot is released;

(c) a locking piston mounted in the binding element, for sliding movement along the longitudinal axis of the ski, the piston being urged, by means of a spring interposed between the piston and the binding element, in the direction of a releasing ramp arranged on the jaw, and (d) a manual release lever adapted to move between a neutral position corresponding to the locked condition of the binding, in which the piston is in contact with the release ramp carried on the jaw, and an operative position following a substantially vertical thrust applied in the direction of the ski and causing the piston to move back against the action of the spring and thus to release the jaw.

Bindings of the type mentioned above have already been disclosed in U.S. Pat. No. 3,778,073, in the name of Georges Pierre Joseph Salomon.

In this known type of binding, the lever pivots about an axle on the binding element and acts upon the locking piston, pushing the latter back, against the action of the spring, when the lever is depressed towards the ski. A part integral with the lever is in contact with a ramp on the locking piston. This part and the ramp may move in relation to each other, and the parts in contact are therefore subjected to friction which may produce wear. This requires that the locking piston be made in a very special way and of a noble material having the smallest possible susceptibility to wear, for instance synthetic materials of the "delryn" type, or alloys such as bronze.

This applies particularly to competition bindings, in which the release stresses are high.

It will be understood that the use of noble materials produces high manufacturing costs. Moreover, the locking-piston ramps are of special configuration (especially as regards the release lug) and this produces machining problems of some magnitude.

Finally, regardless of the strength of the material used, there is no doubt that the presence upon the piston ramp of ridges, acting as release lugs, results in repeated stressing of this more fragile area, in the form of hammering, which may cause wear detrimental to the proper operation of the binding.

It is an object of the present invention to overcome these disadvantages and to allow the locking piston to be made of conventional, much less costly materials, which need no machining, which may have a longer life, and which provide a high degree of safety over a considerable time.

To this end, according to the invention, the operating lever pivots about an axle integral with the locking piston and comprises a ramp system cooperating with a reaction part pertaining to an element in the binding other than the locking piston, the distance between the pivot axle of the lever and the point upon the ramp which comes into contact with the reaction part being less than the distance between the lever pivot axle and the point upon the ramp in contact with the reaction part when the lever is in the neutral position.

This arrangement eliminates any friction between the lever and the sliding piston. It also eliminates the need to transmit stresses in spot zones of the sliding piston, which may cause the piston to deteriorate.

The part used as a reaction part, designed to withstand relatively high stresses, may be a part which is not very fragile, which may easily be replaced, and which does not need to have the special mechanical characteristics required of the sliding piston.

The lever is preferably arranged to rock about an axle integral with the sliding piston, and to bear upon either a part integral with the binding element, or upon a part integral with the jaw.

If the lever bears upon a part integral with the binding element, the reaction part may be the axle about which the jaw pivots, in which case the lever cooperates with the axle by means of a ramp arranged on the lever.

As a variant, the binding element may have a suitable fixed ramp upon which the lever will bear, or possibly a ramp integral with the lever, cooperation between the stationary ramp and the lever, or the ramp thereon, assuring that the locking piston moves back.

In cases in which the lever bears upon the jaw, the latter may, with advantage, be provided with a ramp against which the lever bears, and which will assure that the axle thereof, and therefore the locking piston, moves back.

As a variant, the lever itself may carry a ramp. It is also possible for there to be a ramp both upon the jaw and upon the lever.

Finally, it should be noted that the lever may be actuated:

either without causing the jaw to open, the jaw being released by the action of the locking element and opening when the skier lifts his boot, or, on the contrary, by acting upon the jaw in the direction of opening, either at the beginning or at the end of the movement of the lever.

Furthermore, in order to make it possible for the lever to remain in the depressed position without the user having to keep it there, a system may be provided to hold the lever when it reaches the limit of its downward travel.

A description will now be given, by way of non-restrictive examples, of a plurality of embodiments of the invention, with reference to the drawings attached hereto, wherein.

In the following examples, similar elements will bear the same reference numerals.

Figure 1:
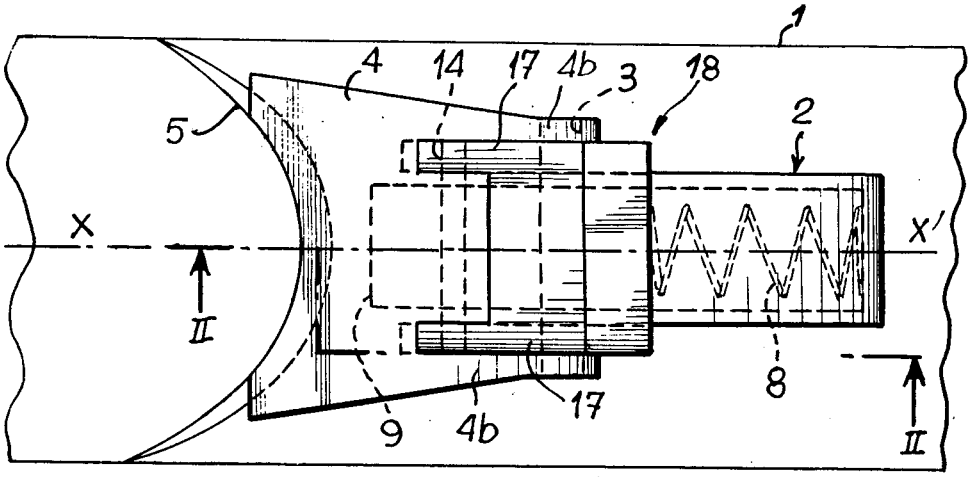
FIG. 1 is a plan view from above of a first embodiment of the binding according to the invention.

Moreover, although the following examples all relate to a heel-piece designed to cooperate with the back of a boot, it is to be understood that the invention could also be applied, by an adaptation within the ability of a technician, to a front stop.

A description will first be given of an example of the binding according to the invention with reference to FIGS. 1 to 4.

In these figures, 1 is a ski to which is secured, by any suitable means, a binding element marked 2 in a general manner. Binding element 2 is traversed by an axle 3 running parallel with the ski and at right angles to the longitudinal axis XX' thereof.

A holding jaw 4, of conventional type, is mounted upon axle 3 in such a manner that the jaw may rock, and the jaw has a pedal providing automatic step-in fitting of the ski to boot 5. This binding will not be described here in detail, since it is of the same type as that described in U.S. Pat. No. 3,778,073.

It is sufficient at this time to point out that binding element 2 has a housing 6 in which is mounted, in such a manner that it may slide in the direction of the longitudinal axis of the ski, a jaw-locking element 7 which, in the examples illustrated, is in the form of a piston of rectangular cross-section adapted to the cross-section of housing 6 which guides the piston.

Located between the rear face of piston 7 and the bottom 6*a* of housing 6 is a spring 8 which keeps piston 7 in contact with jaw 4.

Figure 2:
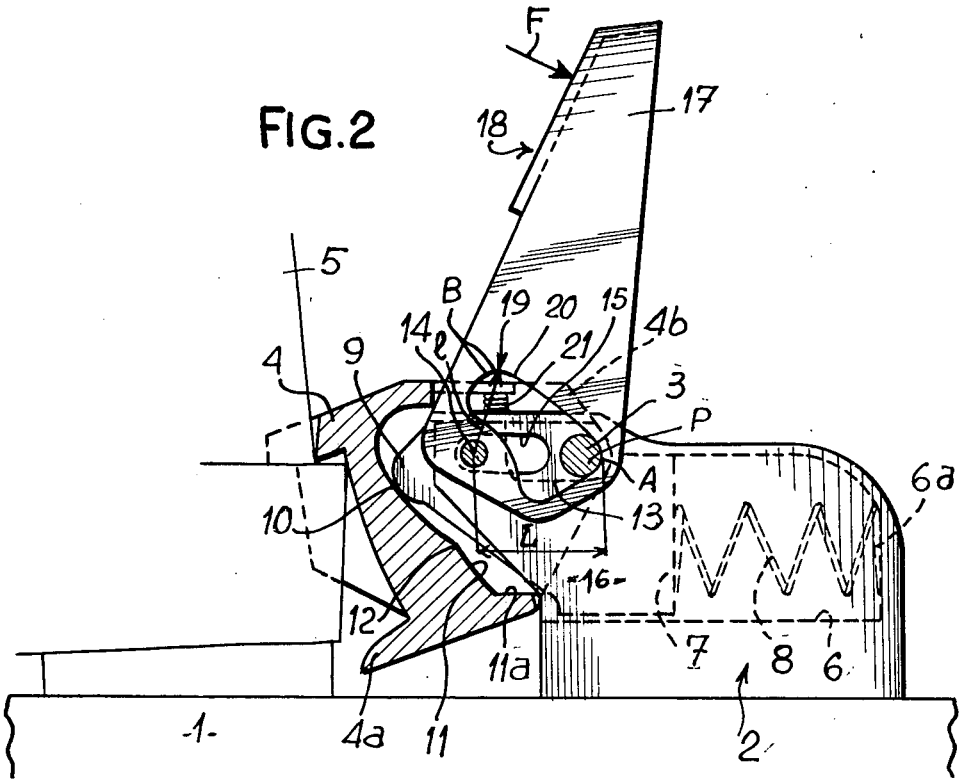
FIG. 2 is a section along the line II—II in FIG. 1.

Located at the front of piston 7 is a rounded nose 9 cooperating with a ramp 10 on the jaw. Ramp 10 is extended downwardly by a ramp 11 which, when the jaw is in the lower position shown in FIG. 2, is centered upon a point P located slightly below and behind axle 3, in such a manner that ramp 11, when it cooperates with nose 9 on the piston, with the jaw in the raised position, assures a slight decompression of spring 8; in other words, ramp 11 has a decompressing action. This arrangement makes it possible to keep the jaw stable in the open position.

Ramps 10 and 11 are separated by a release nose 12 which, upon passing the nose on piston 7, allows the jaw to be raised and the boot to be released. It will be observed that ramp 11 terminates in a stop 11*a* which limits the lifting travel of the jaw when it comes into contact with nose 9 on piston 7 (see FIG. 4).

Since piston 7 slides in housing 6, a cut-out 13 is provided in the upper part of the piston to accommodate axle 3 and prevent the latter from impeding the movement of the piston.

An axle 14, integral with piston 7, passes through the piston in the area between cut-out 13 and nose 9. This axle, which is parallel with axle 3, projects laterally from binding element 2 and passes through substantially horizontal ports 15 located in the side walls 16 of binding element 2.

Mounted upon the projecting ends of axle 14 are the arms 17 of a ski-removal lever, marked 18 as a whole, which is substantially in the form of a U. Port 15 allows axle 14, which moves with piston 7, to move freely.

Each arm 17 of lever 18 is provided, moreover, with a cut-out 19 traversing pivot axle 3 of jaw 4, the cut-out comprising an upper ramp 19 designed to cooperate, in a manner to be explained hereinafter, with axle 3 when lever 18 moves about axle 14.

It will be observed that distance "L" between axle 14 and point "A" on ramp 20 is greater than distance "l" between axis 14 and point "B" on ramp 20 (see FIG. 2).

Figure 4:
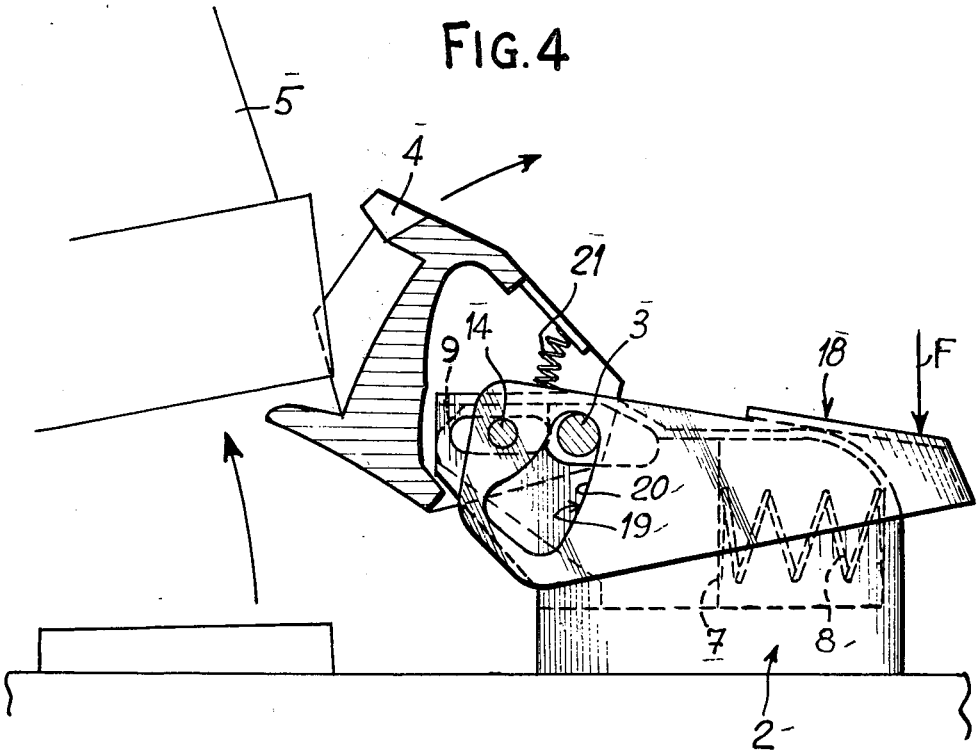
FIG. 4 is a view similar to that in FIGS. 2 and 3, showing the jaw in the open position.

Finally, it will be observed that a small spring 21, designed to assist in opening the jaw, may be provided, as shown in FIG. 2, between binding element 2 and jaw 4, the spring urging the jaw towards the open position thereof shown in FIG. 4.

A description will be given, in conjunction with FIGS. 2, 3 and 4, of the operation of this first embodiment.

The first case to be considered is that in which the boot is held to the ski by the closed binding and it is desired to remove the ski voluntarily.

The initial position is therefore that shown in FIG. 2, in which nose 9 of piston 7 is kept in contact with ramp 10 by spring 8. Ski-removal lever 18 is in its upper position, since axle 14, about which lever 18 pivots, is integral with the piston to which pressure is being applied by spring 8.

In order to remove the ski, the skier merely has to apply a force "F" to the upper end of lever 18 (see FIG. 2), preferably with his ski-pole.

Figure 3:
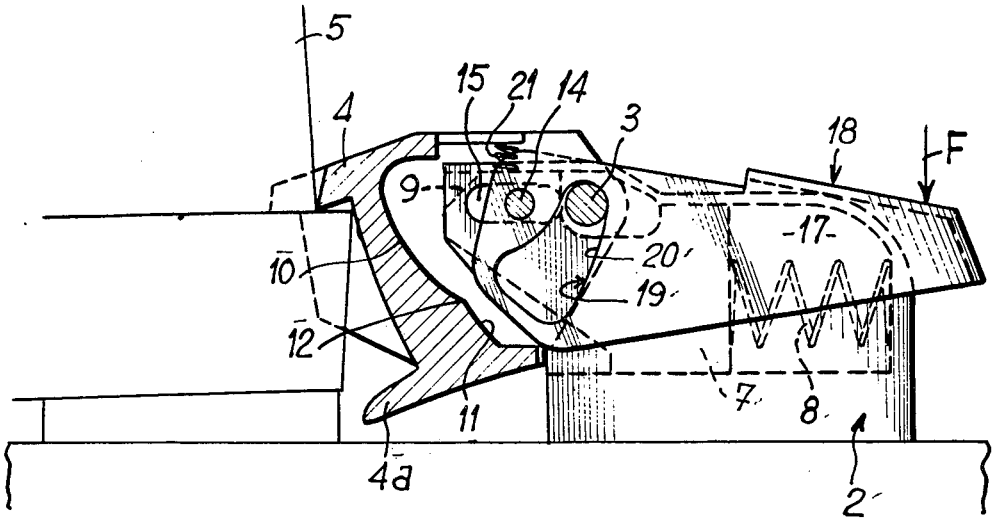
FIG. 3 is a view similar to that in FIG. 2, but showing the lever in the depressed position.

Lever 18 now pivots about axle 14 and moves down to the position shown in FIG. 3. During this pivoting motion, ramp 20, on openings 19 in the lever, slides upon axle 3, causing piston 7 to move back against the action of spring 8. This causes axle 14, about which lever 18 pivots, to move rearwardly in port 15 in binding element 2, to the position shown in FIG. 3.

Now that piston 7 has moved backwards, nose 9 thereof is no longer in contact with ramp 10, and jaw 4 is no longer acted upon by spring 8. At this time, the skier, still keeping lever 18 depressed in the position shown in FIG. 3, need merely lift the heel of his boot (see FIG. 4) in order to release the boot from the binding, since jaw 4 is free to lift and is assisted in so doing by spring 21.

In the case of a release effected by the front stop, the boot may possibly escape without jaw 4 of the heel-piece opening. In this case, the heel-piece will be in the position shown in FIG. 2, but the jaw will not be engaged with the boot. In order to be able to put the ski on again, the skier must open the binding. As indicated above, this may be achieved by applying a force "F" to lever 18, in order to move the lever to the position shown in FIG. 3. Since jaw 4 is now free, spring 21 causes it to open.

It will be noted that the binding described in connection with FIGS. 1 to 4 requires, in order to release the boot, that the skier continues to apply force "F" to the lever as long as the jaw is not open. The reason for this is that the lever is not locked in the depressed position. Locking of the lever in the depressed position is made possible, however, by a variant of the binding illustrated in FIGS. 1 to 4, as shown in FIG. 5.

In this variant, all of the components are identical with those in FIGS. 1 to 4. The only difference is in the opening ramp for lever 18 which cooperates with axle 3 when the lever is depressed, and in the lower part of the lever which now has a nose 25. The ramp, marked 22 in FIG. 5, has a nose 23 near its end "B." In the example illustrated, part 24 of the ramp, between nose 23 and point "B," is an arc of the same radius as axle 3. This part 24, which is set back in relation to part 22 of the ramp, permits, when lever 18 is depressed and nose 23 has passed axle 3, a slight movement of lever 18 in the direction of arrow "D," towards the jaw. Axle 3 is now engaged with part 24, and the lever is locked by the action of spring 8.

Figure 5:
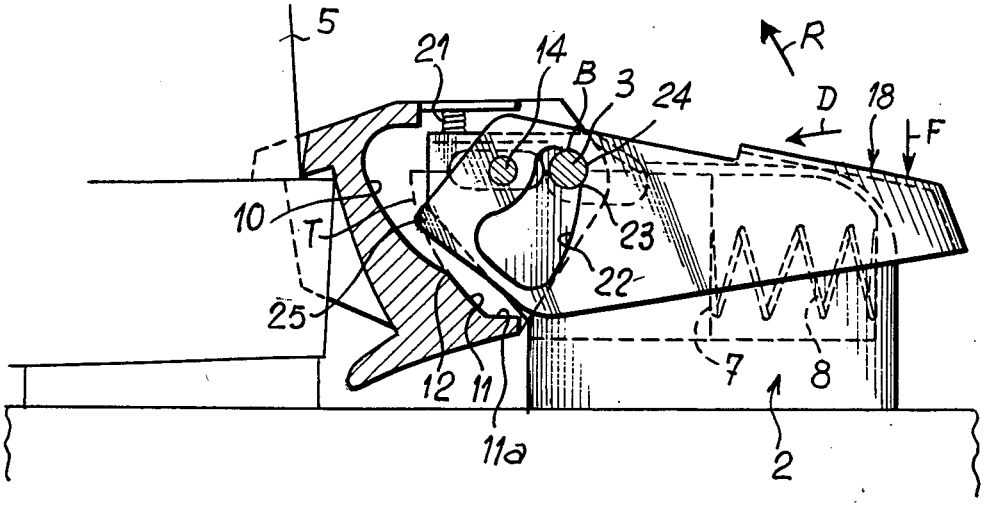
FIG. 5 is a cross-sectional view of a variant of the binding according to FIGS. 1 to 4.

If the ski is to be removed voluntarily, a force is applied, in the direction of arrow "F," with the lever in the raised position, as in FIGS. 1 to 4, to the free end of the lever, which is thus moved to the position shown in FIG. 5. In this position, the lever is locked, as indicated above, by the fact that part 24 of the ramp is engaged with axle 3. It is now no longer necessary for the skier to hold the lever down.

In order to remove the ski, the skier merely lifts the heel of his boot, which causes jaw 4 to pivot about the axle. As the jaw moves upwardly, release nose 12 on the ramp of the jaw moves along a path "T," shown in dotted lines in FIG. 5, and comes up against end 25 of lever 18 (which lies in the path of the nose because lever 18 has moved forward in the direction of arrow "D," as already indicated hereinbefore).

As the jaw continues to rise, nose 12 pushes lever 18 in a direction opposite to that of arrow "D," thus temporarily unlocking the lever. This temporary unlocking is in effect as long as ramp 11 cooperates with end 25 of the lever, but since the ramp has a slight decompressing action (i.e., it allows the piston and lever 18 to move slightly forwards) at the end of the opening movement of the jaw, lever 18 will assume the position shown in FIG. 5, i.e., it will again be locked by cooperation between ramp part 24 and axle 3.

It will be noted that since the jaw, as it rises, applies to the lever a torque tending to keep it in the depressed position, the lever will never rise. Thus, when the jaw is open, the lever is always depressed and spring 8 is armed. The jaw is kept in the raised position by spring 21.

The lever is unlocked when the ski is put on again, i.e., when the skier's boot pushes the jaw down since, on the one hand, ramp 11, acting upon end 25 of the lever, tends to cause the lever to move in the direction of arrow "R" and, on the other hand, ramp 11, which slightly compresses spring 8 as release nose 12 approaches end 25 of the lever, causes the lever to move, in a direction opposite to that of arrow "D," far enough to allow nose 23 on the lever ramp to escape from axle 3.

It will therefore be understood that lever 18 will already have been unlocked by the time axle 3 reaches part 22 of the lever ramp, and the lever will therefore continue to rise of itself, in the direction of arrow "R," until it reaches the position shown in FIG. 2.

Figure 6:
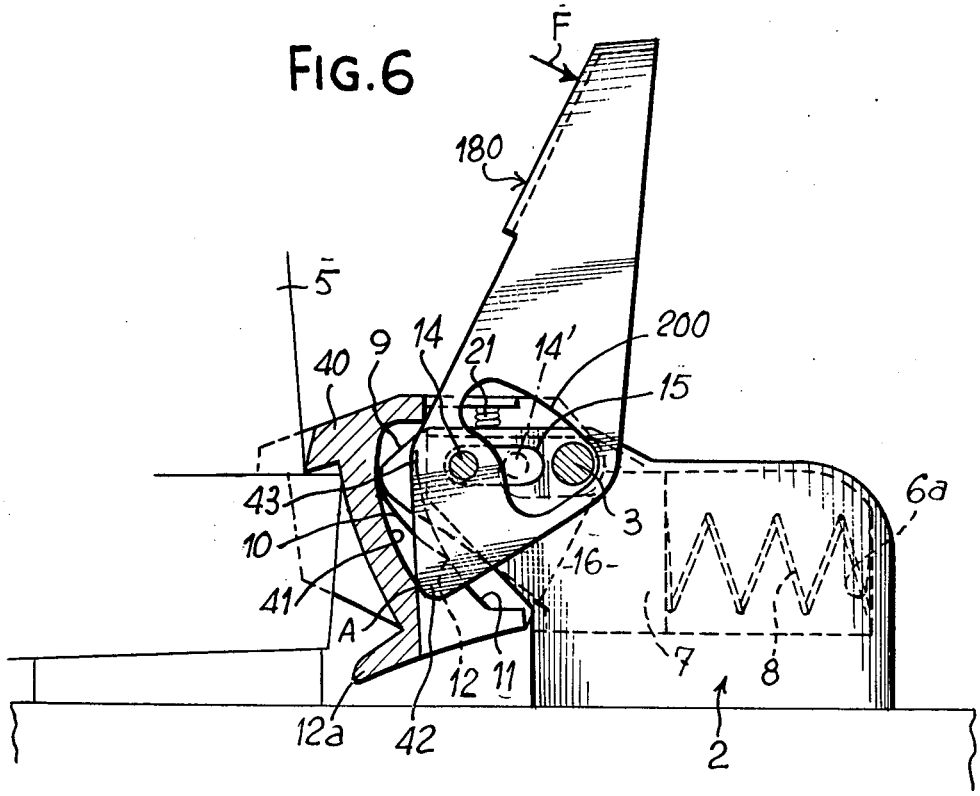
FIG. 6 is a cross-sectional view of another embodiment of a binding according to the invention.
Figure 7:
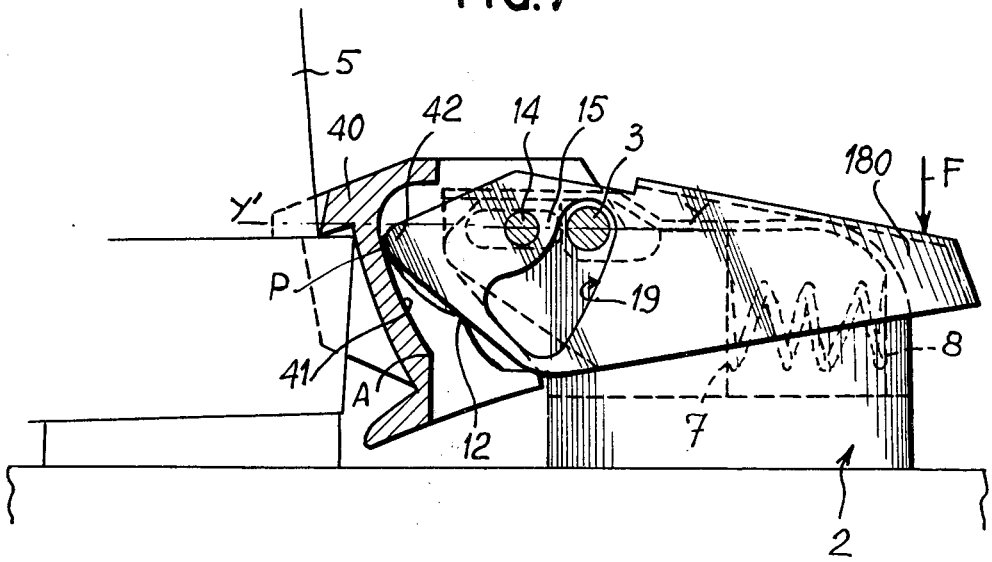
FIG. 7 is a view similar to that in FIG. 6, showing the lever in the depressed position.
Figure 8:
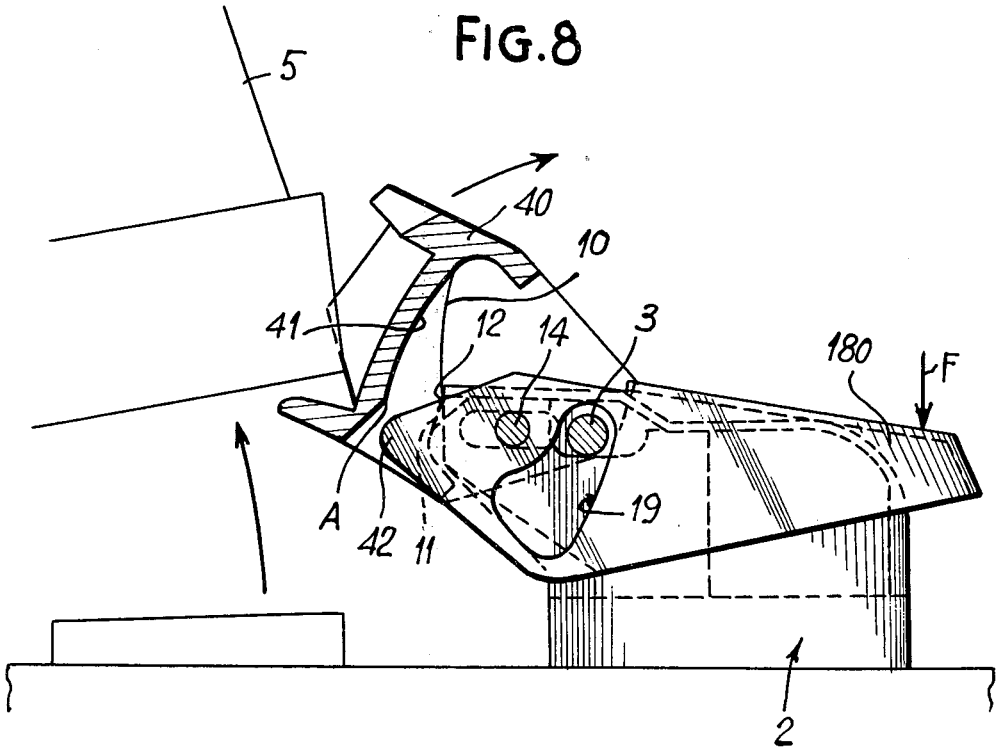
FIG. 8 is a view similar to that in FIGS. 6 and 7, showing the jaw open.

In the embodiment illustrated in FIGS. 6 to 8, instead of the lever cooperating, during its descent, with a stationary part of the binding, as in FIGS. 1 to 5, lever 180 cooperates with jaw 40. To be more precise, jaw 40 comprises, on each side of locking ramp 10,11,12 designed to cooperate with piston 7, ramps 41. A rounded end 42 of lever 180 bears upon each of ramps 41.

As in the preceding example, lever 180 is arranged to pivot about an axle 14 which is integral with piston 7 and which moves in ports 15 in the sides of the binding element. In this particular example of embodiment, the sole purpose of opening 200 in the arm of lever 180 is to allow the lever to move without coming into contact with axle 3 about which the jaw pivots. This opening may therefore be of any desired configuration, since at no time will it come into contact with axle 3. In the example of embodiment illustrated in FIGS. 6, 7 and 8, ramp 41 is centered upon axle 3, but it might also be otherwise, without impairing the operation of the unit.

A description of the operation of this embodiment will now be given, covering the case of voluntary removal of the ski, with the boot in the binding.

In this case, the binding is in the position shown in FIG. 6. Jaw 40 is kept depressed by nose 9, on piston 7, bearing upon part 10 of the central ramp on the jaw.

End 42 of lever 180 is in contact with a ridge "A" at the end of ramp 41, and the lever is therefore held in the raised position. When the lever is moved in the direction of arrow "F," end 42 thereof bears upon edge "A" of ramp 41 on the jaw, and thus urges the jaw in an upward direction. However, since the boot is in the jaw, boot contacting portion **12*a* of jaw 4**, bearing against the boot, will prevent any upward movement of the jaw.

Lever 180 and, more particularly pivot axle 14 thereof on piston 7, is then obliged to move slightly towards the rear. Axle 14 slides in port 15, causing piston 7 to move back against the action of spring 8.

As soon as axle 14 has moved sufficiently far back to allow rounded end 42 of the lever to pass over ridge "A" on the jaw, end 42 comes into cooperation with ramp 41 on the jaw. The backward movement of axle 14 into position 14' has caused the piston to move far enough back to release jaw 40. Actually, nose 9 of the piston is set back in relation to path 43 of release nose 12 on ramp 10, and this allows the jaw to rise. It will be observed that ramp 41 is such that end 42 of the lever applies thereto a force tending to cause the jaw to rise when lever 180 is depressed.

At this time, the skier need only lift his boot to open the jaw and free the boot. In its upper position, the jaw releases the lever, but the piston may move forward again, restoring contact between its nose 9 and the jaw by cooperation with ramp 11. The jaw is thus kept in the raised position (see FIG. 8).

When the jaw is in the closed position shown in FIG. 6, but the boot is no longer on the ski, for instance in the event of a safety release effected by the front stop, the binding must be opened before the ski can be put on again.

Unlocking is achieved, in this case, by applying to lever 180 a force in the direction of arrow "F." At the same time, piston 7 will be moved rearwardly, and jaw 40 will be raised, by the thrust applied by end 42 of the lever to ramp 41 on the jaw.

In order to facilitate the opening of the jaw, it would be possible, although not necessary, to provide a spring 21, as in the preceding embodiment.

In the case of the binding illustrated in FIGS. 6 to 8, the skier must maintain the pressure upon lever 180 when the latter is in the depressed position shown in FIGS. 7 and 8, if he is to be able to open the jaw.

It would be possible to lock the lever in the depressed position, so that it would no longer be necessary for the skier to keep the lever depressed, even when the jaw is still in its lowered position, after which the jaw could rise again without any difficulty.

Figure 9:
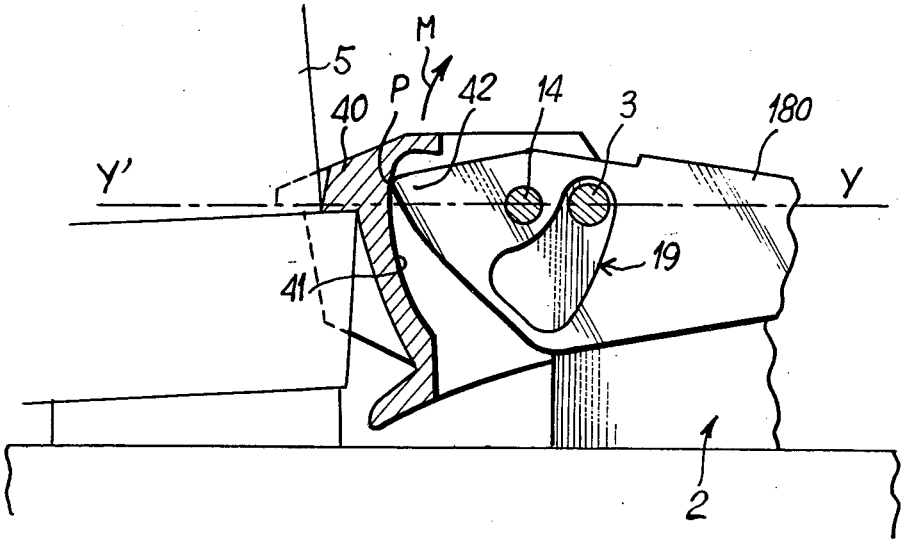
FIG. 9 shows a variant of the binding according to FIGS. 6 and 8.

Since devices for this locking of the lever may be of various types, one design is shown in FIG. 9, and this will be described hereinafter in greater detail.

In this variant, the lever is locked in the low position by the fact that the action of end 42 of the lever at point "P" on ramp 41 provides a torque in relation to axle 14, the effect of which is to keep the lever depressed.

Various arrangements are possible for achieving this effect. Thus in FIG. 9, the design of the lever, and of ramp 41, is such that when the lever reaches the end of its downward movement, point "P," where the lever comes into contact with ramp 41, is located above the line Y'Y common to axles 14 and 3. It will be understood that this keeps the lever depressed, and that raising the jaw in the direction of arrow "M" in FIG. 9 will apply to end 42 of the lever a load acting in the same direction, and this will be sufficient to keep the lever depressed.

According to a variant, locking of the lever may be obtained by not centering ramp 41 upon axle 3. It will be sufficient in this case to provide a slight decompressing action, by locating the center of this ramp slightly higher in relation to axle 3 (when the jaw is in the low position). As a result of this, the action of the jaw upon the lever produces a torque tending to keep the lever depressed.

It would also be possible for the lever to have a positive action upon the jaw upon removal of the ski, the positive action forcing the jaw to move upwardly and tending to raise the heel of the boot.

Figure 10:
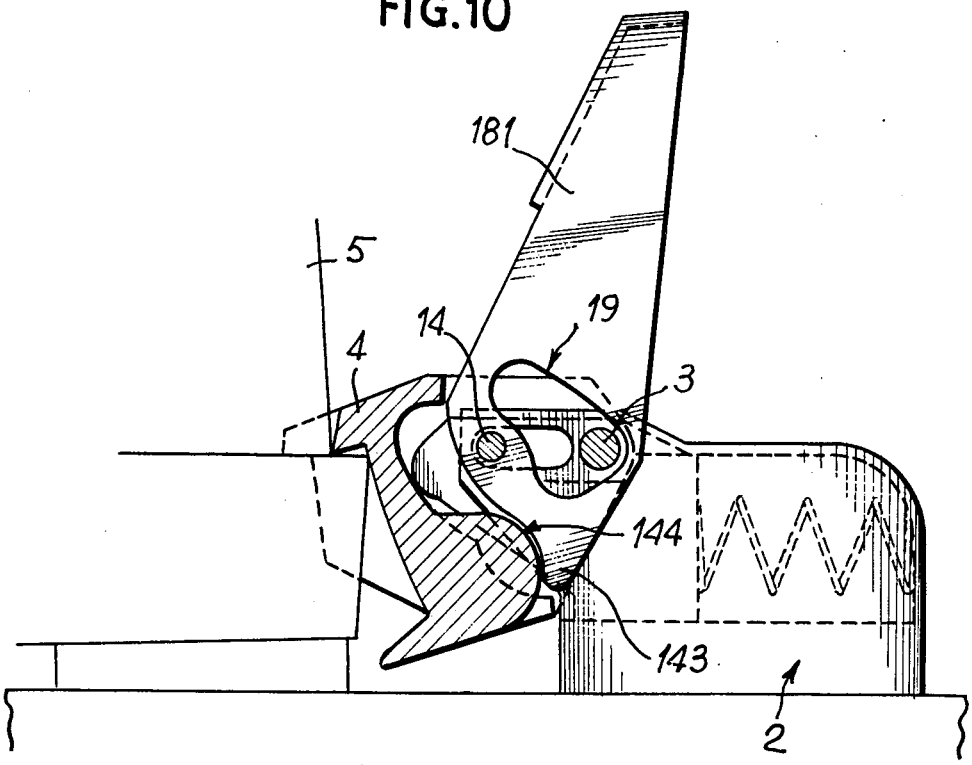
FIG. 10 is a longitudinal section of another embodiment of a binding, with the boot in position.
Figure 11:
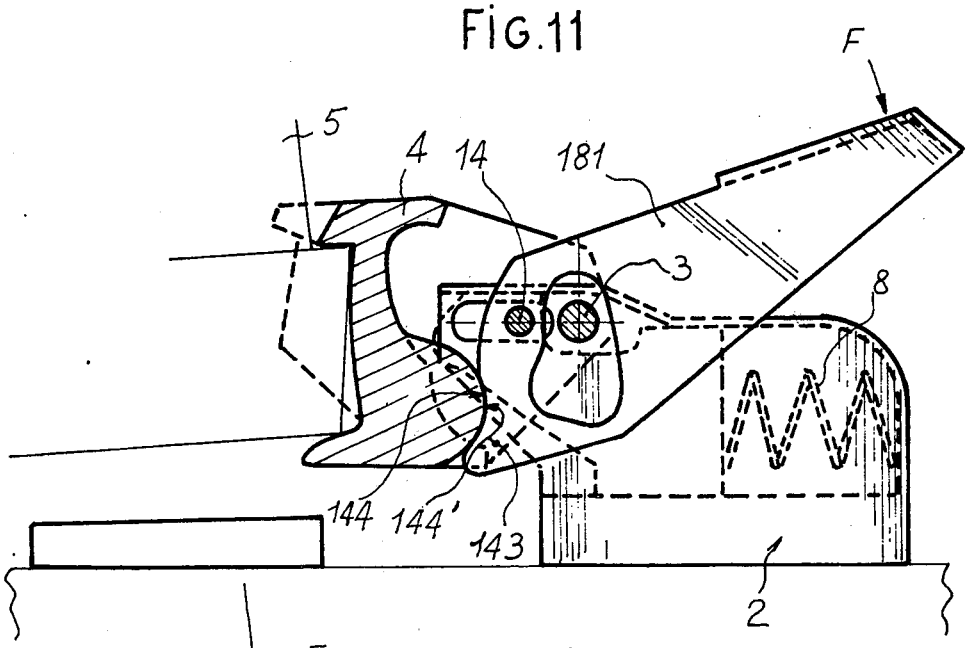
FIG. 11 shows the binding in FIG. 10 in the course of voluntary removal of the ski.

A device of this kind could be designed as shown in FIGS. 10 and 11, for example.

It will be observed that, according to this variant, the lever forces the jaw to open right from the start of, and during, the travel of the lever in the downward direction. The heel of the boot therefore lifts at the same time. To this end, lever 181 has a nose 143 cooperating with a ramp 144 projecting from the jaw. The nose has a ramp 144'. When the lever is moved in the direction of arrow "F" (FIG. 11), ramp 144' on the lever takes over ramp 144, which forces the jaw to open and the piston to move back simultaneously. Ramps 144 and 144' are substantially complementary and of revolution shape preferably, in order to provide the largest possible area of contact between the lever and the jaw, not only in order to reduce contact pressures, but also in order to assure a minimum of relative movement between the points of contact in the course of the movement.

Figure 12:
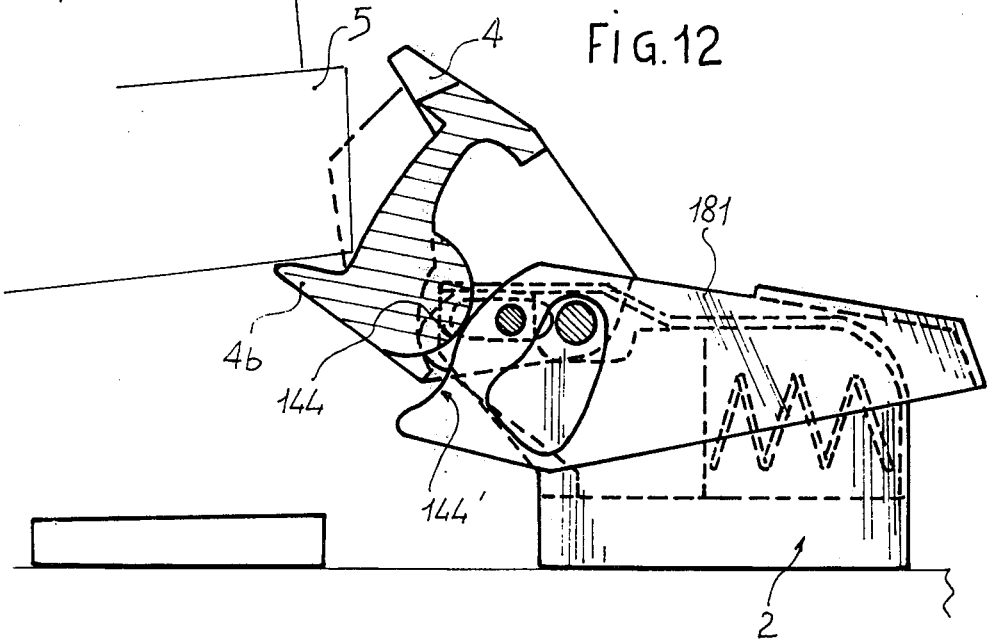
FIG. 12 shows the binding according to FIGS. 10 and 11 at the start of the operation of putting on the ski.

In the embodiment illustrated in FIGS. 10 to 12, ramp 144 is a male profile in the form of a part of a convex cylinder, whereas ramp 144' is a female profile in the form of a part of a concave cylinder of substantially the same radius.

It may be seen in FIG. 11 that the raising of the jaw, the backward movement of the piston, and the lifting of the heel all occur simultaneously.

In FIG. 12, the heel-piece is ready to be engaged. In putting on the ski, the heel of boot 5 bears upon pedal **4*b* of jaw 4, thus moving the jaw down against the action of the piston. Projecting ramp 144 on the jaw enters into cooperation with ramp 144' on lever 181, thus forcing the latter to rise and assume the position shown in FIG. 10**. At the same time, the pivot comes to bear upon the jaw-releasing ramp.

It should be noted that any components shown in FIGS. 10, 11, 12, and not described, are identical with those in FIGS. 7 and 8, namely: the piston, the body, the spring, the lever, with the exception of lower part 143, and the jaw, with the exception of projecting ramp 144.

Finally, it is pointed out that it is possible, without departing from the scope of the invention, to design a binding in which the lever would cooperate with a part of the binding during one phase of unlocking, and with the jaw during another phase of unlocking.

What is claimed is:

1. A safety binding for securing a boot to a ski and comprising:

(a) a binding element mounted upon said ski and having a housing extending in the direction of the longitudinal axis of said ski;

(b) a jaw articulated to said binding element on an axle in such a manner that said jaw may rock between a first position in which said boot is secured to said ski, and a second position in which said boot is released;

(c) a locking piston mounted in said housing of said binding element in such a manner that said piston may slide in the direction of the longitudinal axis of said ski, said piston being urged, by means of a spring interposed between said binding element and said piston, in the direction of a releasing ramp arranged upon said jaw; and (d) a manual release lever which, from a neutral position corresponding to the locked binding position in which said piston is in contact with said jaw-releasing ramp, may be moved downwardly in the direction of said ski, thereby causing said piston to move back in said housing against the action of said spring, (e) said lever being pivotably connected to said locking piston and having a portion slidably bearing upon a reaction part associated with a binding member other than said locking piston.

2. A binding according to claim 1, said axle of the jaw constituting said reaction part.

3. A binding according to claim 2, wherein said ramp portion arranged on said lever is part of a port cut out of said lever, into which said axle of said jaw extends.

4. A binding according to claim 1, wherein said jaw constitutes said reaction part, said portion bearing upon said jaw.

5. A binding according to claim 1, comprising means for locking said lever at the end of its downward movement corresponding to the release of said jaw.

6. A binding according to claim 5, wherein said axle of said jaw constitutes said reaction part and said means for locking said lever at the end of its downward movement comprises a nose on said ramp portion of said lever.

7. A binding according to claim 5, wherein at the end of the downward movement of said lever, the point of contact between said lever and said jaw is located above the line joining the pivot axis of said jaw and the axis of rotation of said lever.

8. A binding according to claim 4, including another ramp on said jaw, said lever portion comprising a part in contact with said other ramp on said jaw and being guided thereon.

9. A binding according to claim 8, including means for locking said lever at the end of its downward movement, said locking means comprising the configuration of the ramp of said jaw with which said lever cooperates.

10. A binding according to claim 8, wherein said part of said lever portion projects under a part of said other ramp of said jaw in a manner such that actuation of said lever causes said lever part to apply on said jaw ramp a force resulting in the opening of said jaw.

11. A binding according to claim 8, wherein said part of said lever portion and said ramp of said jaw are shaped to complement each other.

12. A binding according to claim 11, wherein said part of said lever and said ramp on said jaw are of a generally revolution shape.

13. A binding according to claim 12, wherein said part of said lever and said ramp on said jaw are in the form of portions of a cylinder, one being convex and the other being concave.

14. A binding according to claim 1, wherein the axis of rotation of said lever passes through the side walls of said housing, through elongated ports arranged in said walls and extending substantially parallel to the longitudinal axis of said ski.

15. A safety binding according to claim 1, wherein said lever portion cooperating with said reaction part is in the shape of a ramp.

* * * * *